US007686063B2

(12) United States Patent
Kirby et al.

(10) Patent No.: US 7,686,063 B2
(45) Date of Patent: Mar. 30, 2010

(54) MOTORIZED DRAPERY SYSTEM HAVING A PULL-AWAY MASTER CAR

(75) Inventors: David A. Kirby, Zionsville, PA (US); Kurt Adam Miller, North Catasauqua, PA (US); Peter W. Ogden, Jr., Macungie, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 125 days.

(21) Appl. No.: 12/133,078

(22) Filed: Jun. 4, 2008

(65) Prior Publication Data

US 2009/0301668 A1 Dec. 10, 2009

(51) Int. Cl.
*A47H 1/00* (2006.01)

(52) U.S. Cl. ..... 160/331; 160/345

(58) Field of Classification Search ..... 160/331, 160/340, 341, 344, 345, 193, 188, 168.1 V; 104/89, 94, 95; 198/678.1, 687, 465.4; 16/87.6 R, 16/95 R, 91, 97; 105/148, 154, 155; 24/458; 49/139, 140

See application file for complete search history.

(56) References Cited

U.S. PATENT DOCUMENTS 3,736,620 A * 6/1973 Williamson ..... 16/87.4 R
3,753,457 A * 8/1973 Bratschi ..... 160/331
3,834,316 A * 9/1974 Hennings ..... 104/291
4,495,671 A * 1/1985 Comeau et al. ..... 16/87 R
4,914,360 A 4/1990 Hsieh et al.
4,919,054 A * 4/1990 Matsuo ..... 104/94
5,542,149 A * 8/1996 Yu ..... 16/87.4 R
5,791,394 A * 8/1998 Huang ..... 160/345
5,889,377 A 3/1999 Mao
5,970,578 A * 10/1999 Mensching et al. ..... 16/94 R
6,076,592 A 6/2000 Grutzner (Continued)

FOREIGN PATENT DOCUMENTS

WO WO 2008/057894 A 5/2008

OTHER PUBLICATIONS

European Patent Office, International Search Report and Written Opinion for International Patent Application No. PCT/US2009/044756, Aug. 17, 2009, 14 pages.

*Primary Examiner*—Katherine W Mitchell
*Assistant Examiner*—Jaime F Cardenas-Garcia
(74) *Attorney, Agent, or Firm*—Mark E. Rose; Philip N. Smith; Bridget L. McDonough

(57) ABSTRACT

A drapery system for moving a suspended drapery fabric allows the drapery fabric to be decoupled from a drive system, such that the drapery fabric may be manually moved. The drapery system comprises a master car comprising a driven portion and a non-driven portion. The driven portion is coupled to a drive belt of the drive system, while the non-driven portion is coupled to the drapery fabric. The master car comprises a spring having a snap adapted to be received in a snap-receiving structure, such that the driven portion is coupled to the non-driven portion. The non-driven portion is operable to move in response to movement of the drive belt to move the drapery fabric when the non-driven portion is coupled to the driven portion. The non-driven portion is operable to be decoupled from the driven portion, such that the position of the drapery fabric may be manually adjusted.

23 Claims, 15 Drawing Sheets

U.S. PATENT DOCUMENTS 6,141,827 A * 11/2000 Wu ..... 16/91
6,144,177 A 11/2000 Mao
6,297,604 B1 10/2001 Mao
6,516,575 B2 * 2/2003 Haab et al. ..... 52/243.1
6,886,218 B2 5/2005 ter Braak
6,935,403 B2 * 8/2005 Killo et al. ..... 160/331
6,994,145 B2 * 2/2006 Killo et al. ..... 160/331
2003/0106653 A1 * 6/2003 Braak ..... 160/331
2003/0121621 A1 7/2003 Killo et al.
2003/0121622 A1 * 7/2003 Killo et al. ..... 160/331
2003/0221282 A1 * 12/2003 ter Braak ..... 16/87.4 R
2004/0173117 A1 * 9/2004 Galpin et al. ..... 105/148
2008/0105390 A1 * 5/2008 Vrielink ..... 160/341
2008/0289778 A1 * 11/2008 Vrielink ..... 160/331

* cited by examiner

MOTORIZED DRAPERY SYSTEM HAVING A PULL-AWAY MASTER CAR

BACKGROUND OF THE INVENTION

1. Field of the Invention

The present invention relates to a motorized drapery system for moving a suspended drapery fabric, and more particularly, to a motorized drapery system that includes a master car having a non-driven portion that may be decoupled and pulled away from a driven portion of the master car.

2. Description of the Related Art

Motorized drapery systems allow for movement of a suspended drapery fabric covering, for example, a window or other opening. Typical motorized drapery systems include a drive system having a reversible motor that turns a drive pulley for moving a drive belt within an elongated track. The drive belt is connected to a master car to provide for movement of the master car in two opposite directions depending on the direction that the reversible motor is driving the drive belt. The drapery fabric is attached to the master car and a plurality of auxiliary cars that do not engage the drive belt. The master car and auxiliary cars include wheels received within the track to provide rolling movement of the cars. An elongated slot is provided in the track for connection between the cars positioned within the track and suspended drapery fabric.

Since the master car is fixedly connected to the drive belt, the drapery fabric may only be opened and closed by the drive system. Some prior art drapery systems have allowed a user to decouple the drapery fabric, such that user is able to manually adjust the position the drapery fabric (i.e., by gripping and pulling the drapery fabric). However, these systems either require multiple tracks for the master car and the auxiliary cars or require master cars of a large physical size, which prevents the drapery system from being used with all types of drapery fabrics, such as split-draw and ripple-fold draperies. Therefore, there is a need for a drapery system having a single track and a low-profile master car, which can used with split-draw and ripple-fold draperies and is able to be decoupled from the drive system when the user pulls on the drapery fabric.

SUMMARY OF THE INVENTION

According to an embodiment of the present invention, a drapery system for moving a suspended drapery fabric comprises an elongated track having belt channels and a drapery car channel, a drive belt received within the belt channels of the track, and a master car received within the drapery car channel of the track and having a driven portion and a non-driven portion. The driven portion of the master car is coupled to the drive belt, while the non-driven portion is adapted to be coupled to the drapery fabric. The driven portion and the non-driven portion comprise a plurality of vertically-oriented wheels adapted to roll through the drapery car channel. The master car comprises a spring having a snap adapted to be received in a snap-receiving structure, such that the driven portion is coupled to the non-driven portion. The non-driven portion is operable to roll through the drapery car channel in response to movement of the drive belt to move the drapery fabric along the length of the track when the non-driven portion is coupled to the driven portion. The non-driven portion is operable to be decoupled from the driven portion, such that the drapery fabric may be manually moved along the length of the track.

According to another embodiment of the present invention, the tension in the spring is adjustable to allow for adjustment of the amount of force required to couple and decouple the driven and non-driven portions. According to yet another embodiment of the present invention, the non-driven portion further comprises a drapery attachment bar adapted to be attached to the drapery fabric, first and second pairs of vertically-oriented wheels, and first and second horizontally-oriented wheels. The vertically-oriented wheels have diameters less than the distance between the top to the bottom of the drapery car channel and the axes of rotation of the vertically-oriented wheels are offset from each other in a vertical direction, such that the wheels are prevented from binding if the drapery attachment bar is pulled in a vertical direction as the master car moves along the length of the track. The axes of rotation of the horizontally-oriented wheels are offset from each other in a horizontal direction, such that the wheels are prevented from binding if the drapery attachment bar is pulled in a horizontal direction as the master car moves along the length of the track.

A master car for a drapery system for moving a suspended drapery fabric is also described herein. The drapery system comprises an elongated track having belt channels and a drapery car channel, and a drive belt received within the belt channels of the track. The master car comprises a driven portion, a non-driven portion, a snap-receiving structure, and a spring. Both the driven portion and the non-driven portion are adapted to be received within the drapery car channel of the track. The driven portion is adapted to be coupled to the drive belt and comprises a plurality of vertically-oriented wheels adapted to roll through the drapery car channel. The non-driven portion comprises a drapery attachment bar adapted to be coupled to the drapery fabric and a plurality of vertically-oriented wheels adapted to roll through the drapery car channel. The spring has a snap adapted to be received by the snap-receiving structure, such that the non-driven portion is coupled to the driven portion. The non-driven portion is operable to roll through the drapery car channel in response to movement of the drive belt when the non-driven portion is coupled to the driven portion. The non-driven portion is operable to be decoupled from the driven portion, such that the drapery fabric may be manually moved along the length of the track.

Other features and advantages of the present invention will become apparent from the following description of the invention that refers to the accompanying drawings.

DETAILED DESCRIPTION OF THE INVENTION

Figure 1:
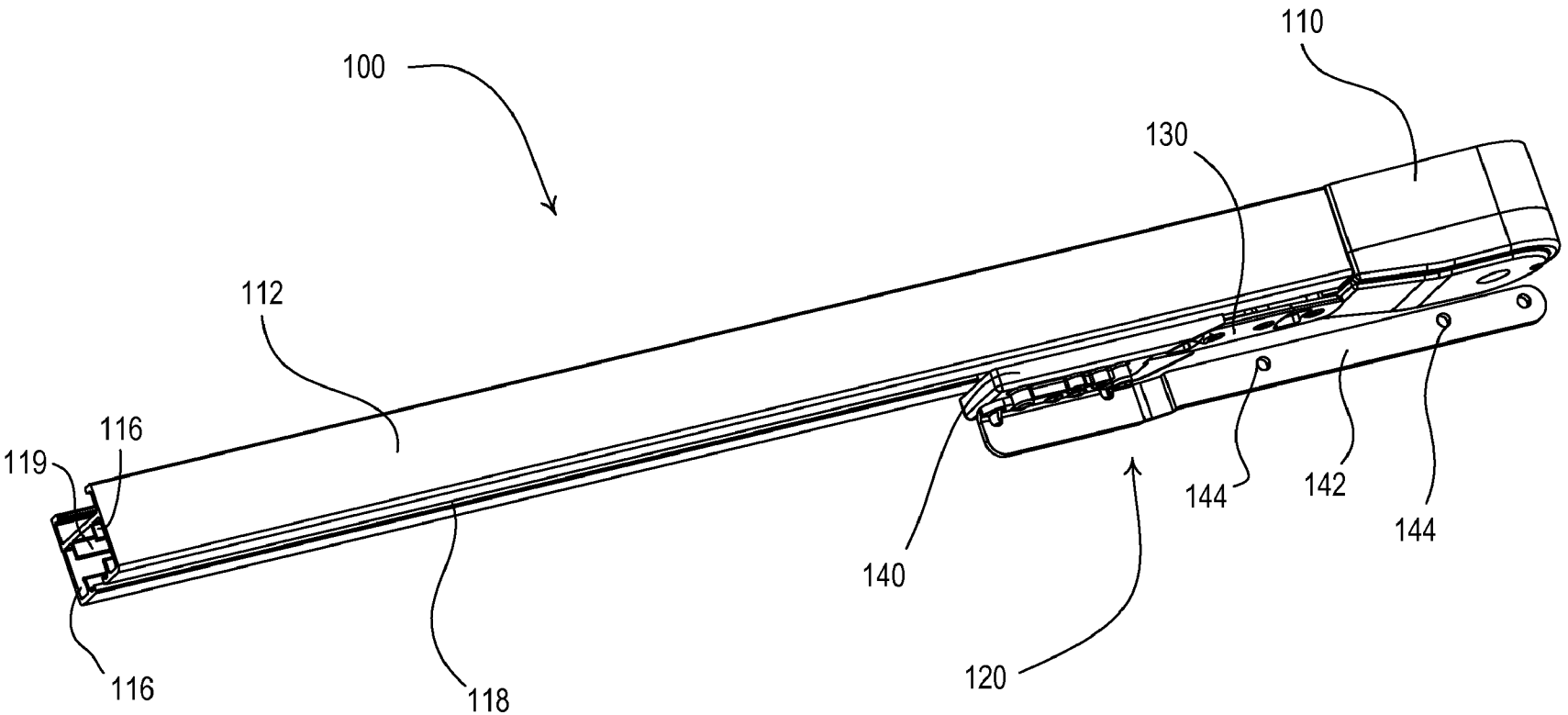
FIG. 1 is a perspective view of a motorized drapery system according to a first embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 2:
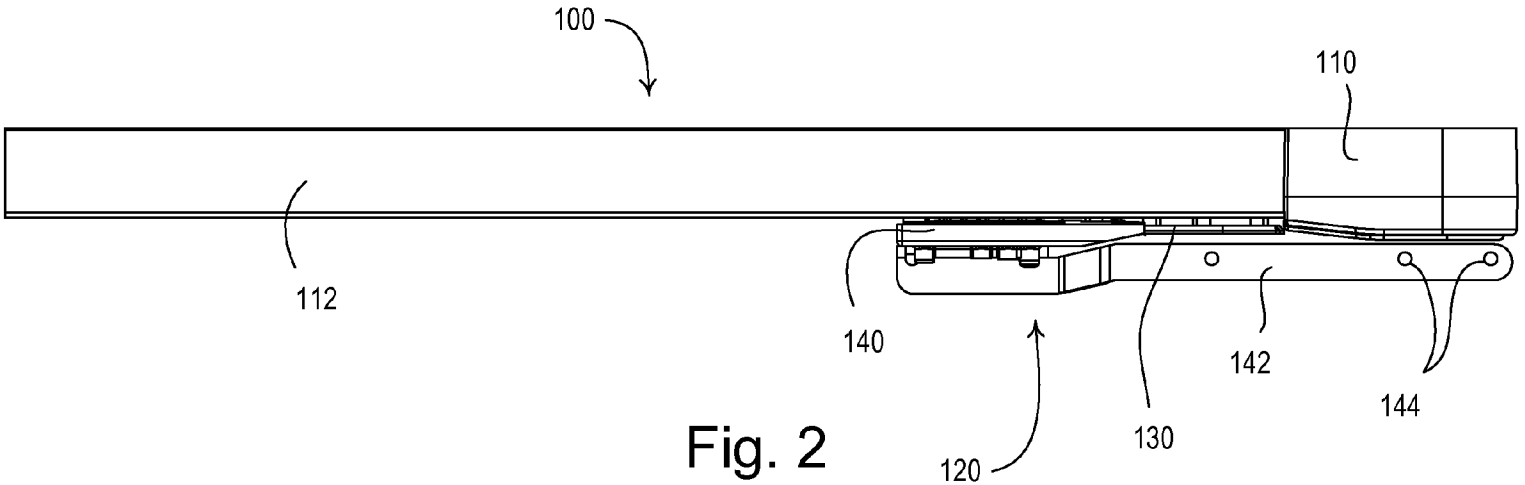
FIG. 2 is a front view of the motorized drapery system of FIG. 1.
Figure 3:
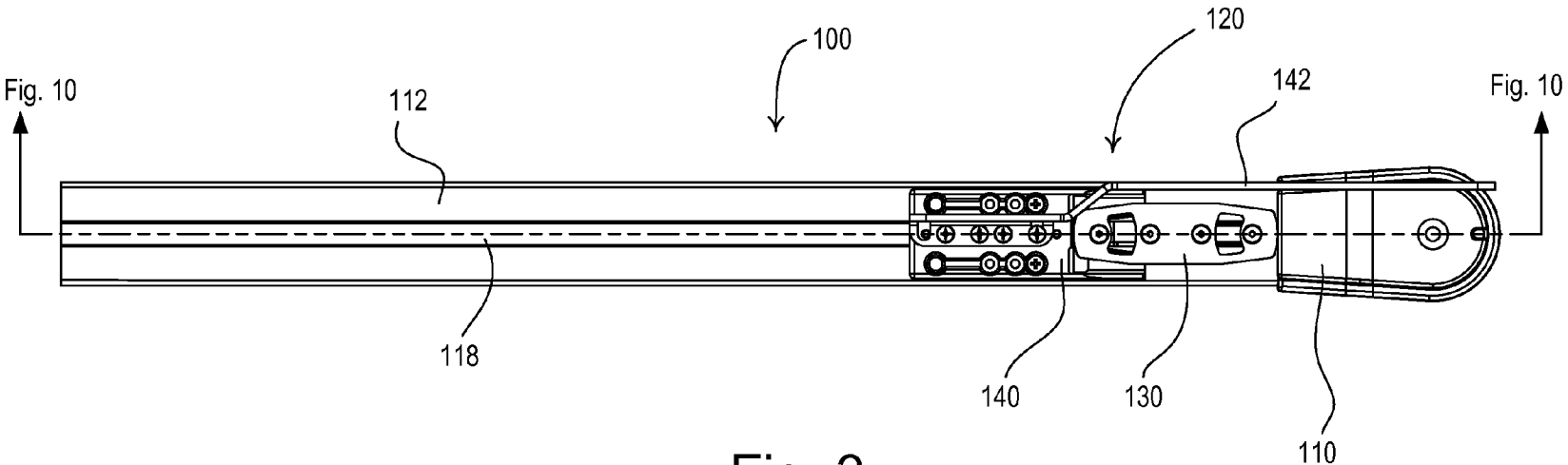
FIG. 3 is a bottom view of the motorized drapery system of FIG. 1.

FIG. 1 is a perspective view, FIG. 2 is a front view, and FIG. 3 is a bottom view of a portion of a motorized drapery system 100 for movement of a suspended drapery fabric (not shown) for covering an opening (such as, for example, a window) according to a first embodiment of the present invention. The drapery system 100 operates to move the drapery fabric between a fully open position (in which the window is not covered by the drapery fabric) and a fully closed position (in which window is completely covered by the drapery fabric).

The drapery system 100 includes an idler end 110 at a first end of a track 112. While not shown in FIGS. 1-3, the track 112 extends further away from the idler end 110 (i.e., to the left as shown in FIG. 1) for the length of the window or other opening that the drapery fabric is covering. A drive end (not shown) is provided at the second end of the track 112 and is adapted to be coupled to a reversible motor (not shown). A drive belt 115 (FIGS. 12-15) extends through the drive end, the idler end 110, and belt channels 116 of the track 112 and is driven by the motor through a drive pulley (not shown) in the drive end.

The drapery system 100 comprises a master car 120 having a driven portion 130 and non-driven portion 140. The non-driven portion 140 includes a drapery attachment bar 142 to allow for attachment to the suspended drapery fabric via openings 144. The master car 120 extends through an elongated slot 118 and is operable to travel through a drapery car channel 119 of the track 112. The drapery system 100 also comprises a plurality of auxiliary cars (not shown) that also travel through the drapery car channel 119 and extend through the elongated slot 118 to connect to the drapery fabric. The driven portion 130 of the master car 120 is coupled to the drive belt 115, such that the master car and the auxiliary cars are operable to move in response to the movements of the belt. The drive system (including the drive end of the track 112, the motor, and the drive pulley) and the auxiliary cars are shown and described in greater detail in U.S. Pat. No. 6,935,403, issued Aug. 30, 2005, and U.S. Pat. No. 6,994,145, issued Feb. 7, 2006, both entitled MOTORIZED DRAPERY PULL SYSTEM. The entire disclosures of both patents are hereby incorporated by reference.

Figure 4:
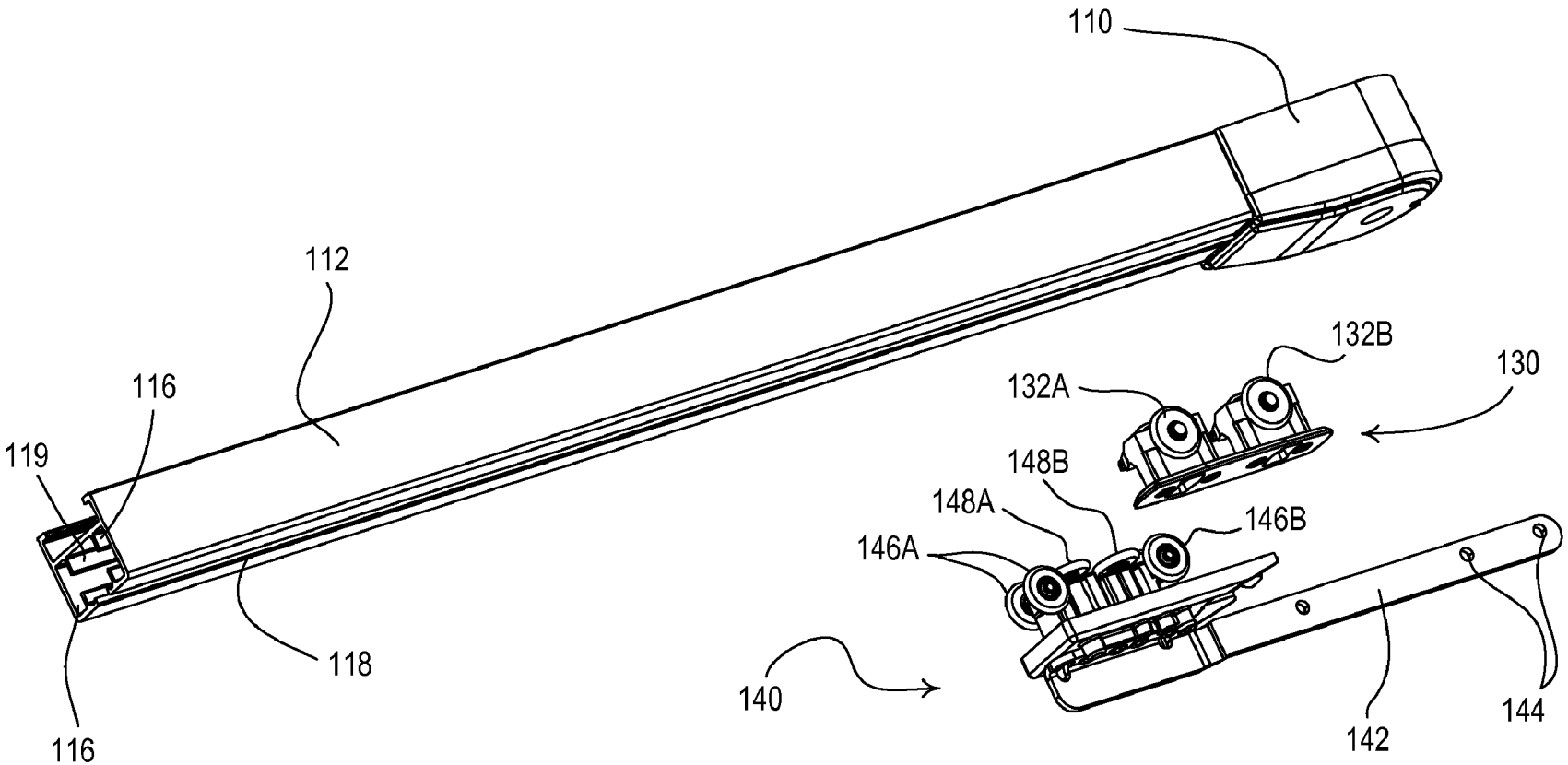
FIG. 4 is a partially-exploded view of the motorized drapery system of FIG. 1 showing a master car having a driven portion and a non-driven portion.

FIG. 4 is a partially-exploded view of the motorized drapery system 100 showing the driven portion 130 and the non-driven portion 140 of the master car 120 in greater detail. The driven portion 130 of the master car 120 comprises two pairs of vertically-oriented wheels 132A, 132B, while the non-driven portion 140 of the master car 120 comprises two pairs of vertically-oriented wheels 146A, 146B and two horizontally-oriented wheels 148A, 148B. The wheels 132A-148B of the driven and non-driven portions 130, 140 are adapted to roll through the drapery car channel 119 of the track 112 as will be described in greater detail below. Alternatively, the master car 120 may not comprise wheels 132A-148B, but could be adapted to slide along the bottom surface of the drapery car channel 119 of the track 112.

The driven portion 130 and the non-driven portion 140 are adapted to be coupled (e.g., snapped) together. When the driven and non-driven portions 130, 140 are coupled together, a user is operable to grasp the drapery fabric, which is attached to the drapery attachment bar 142 of the non-driven portion 140, and pull the non-driven car 142 away from the driven portion 130 to thus decouple the driven and non-driven portions 130, 140. The user is then able to manually move the drapery fabric along the length of the track 112 (e.g., by gripping and pulling the drapery fabric). When decoupled, the driven and non-driven portions 130, 140 may be coupled back together in response to the drive system moving the drive belt 115 until the driven portion contacts the non-driven portion and the driven and non-driven portions snap back together. The coupling and decoupling of the driven and non-driven portions 130, 140 of the master car 120 will also be described in greater detail below.

Figure 5:
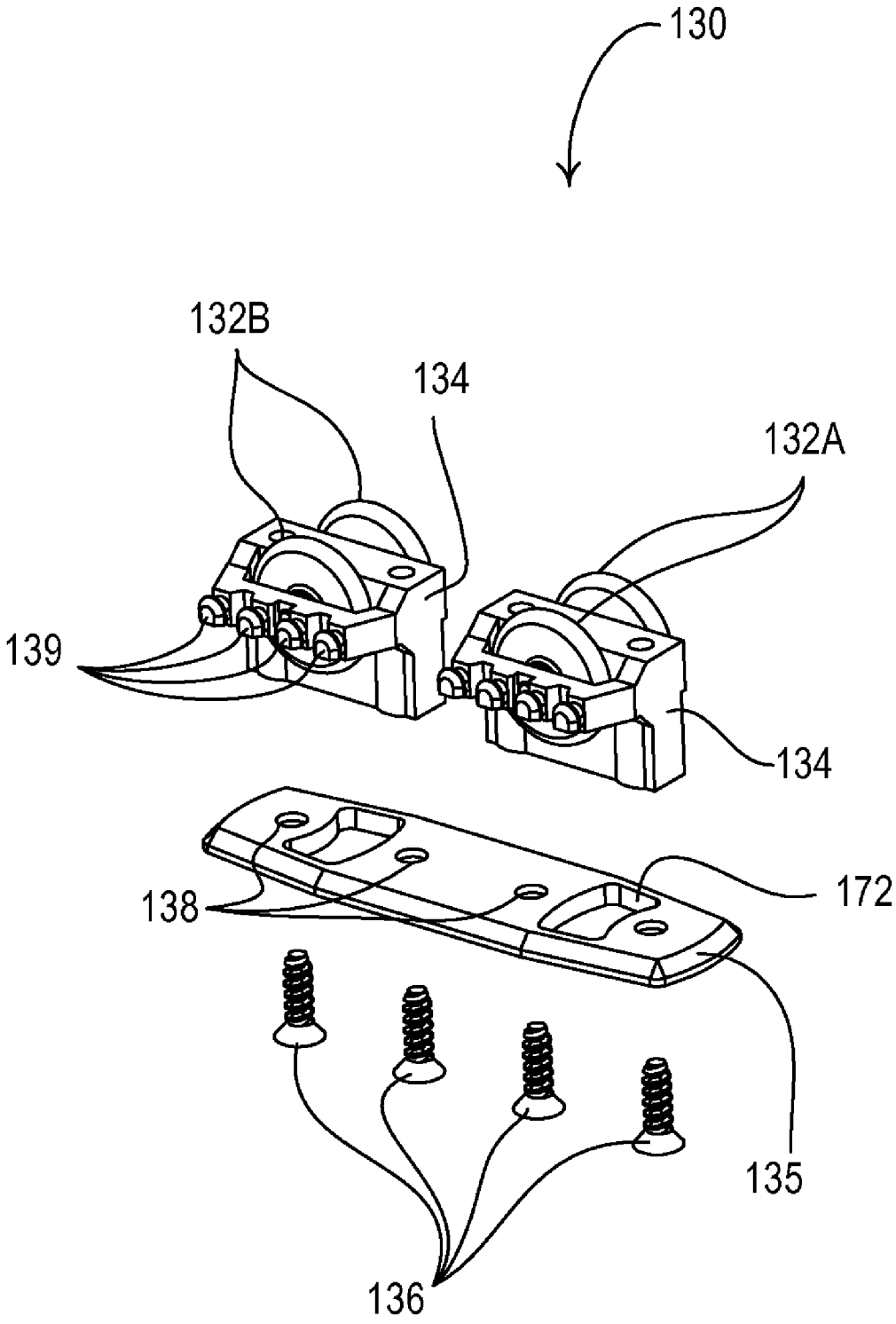
FIG. 5 is an exploded view of the driven portion of the master car of FIG. 4.

FIG. 5 is an exploded view of the driven portion 130 of the master car 120. The wheels 132A, 132B are rotatably mounted to two wheel supports 134, which are connected to a base 135. Specifically, four screws 136 are received through openings 138 in the base 135 and attach to the wheel supports 134. The wheel supports 134 each include a plurality of posts 139, which are used to couple the driven portion 130 to the drive belt 115. For example, the drive belt 115 may have two ends, and each end of the belt may be attached to the posts 139 of one of the wheel supports 134. Accordingly, the drive system is operable to move the driven portion 130 of the master car 120 to thus move the drapery fabric that is attached to the drapery attachment bar 142 of the non-driven portion 140.

Figure 6:
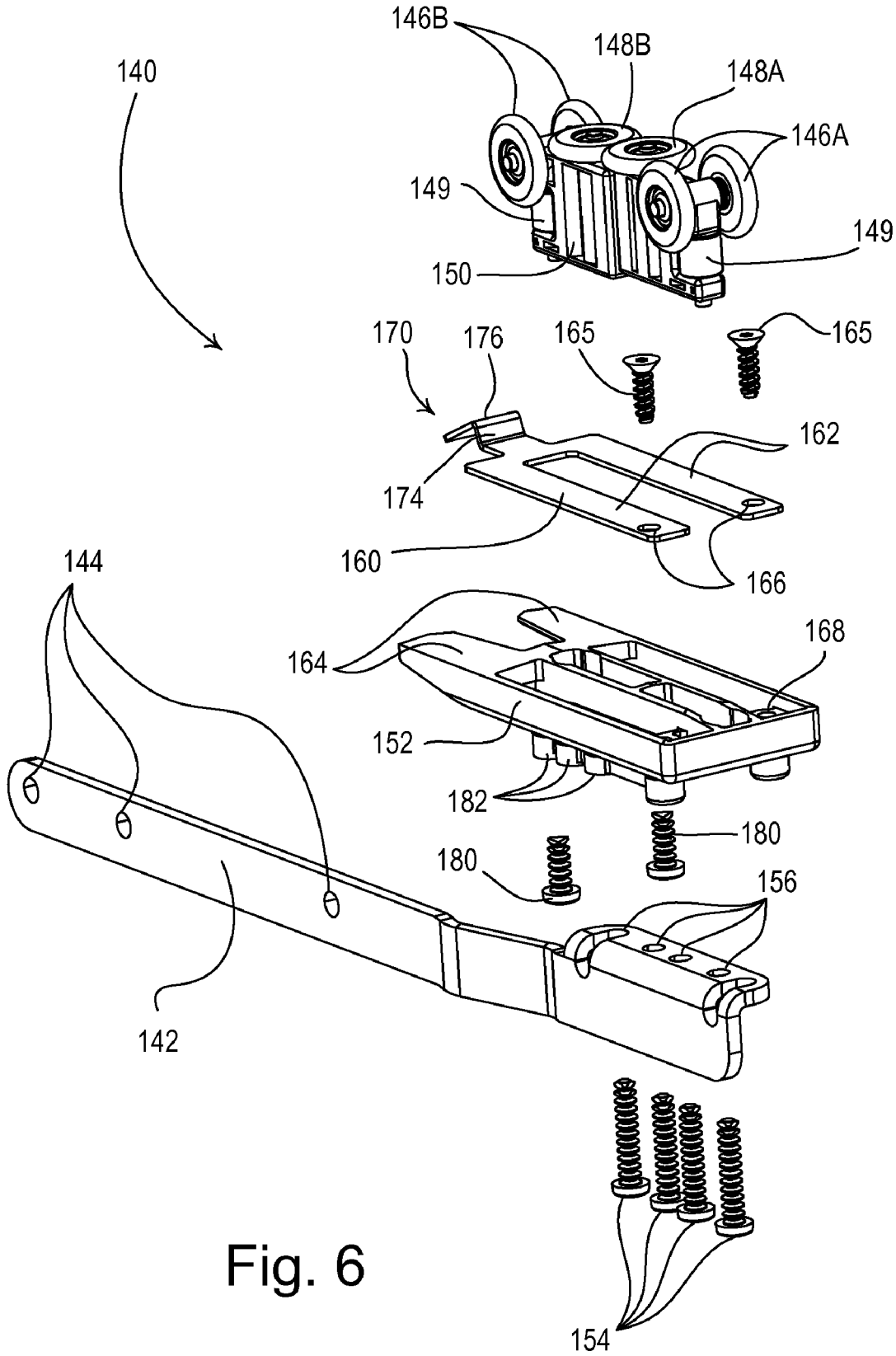
FIG. 6 is an exploded view of the non-driven portion of the master car of FIG. 4.
Figure 7:
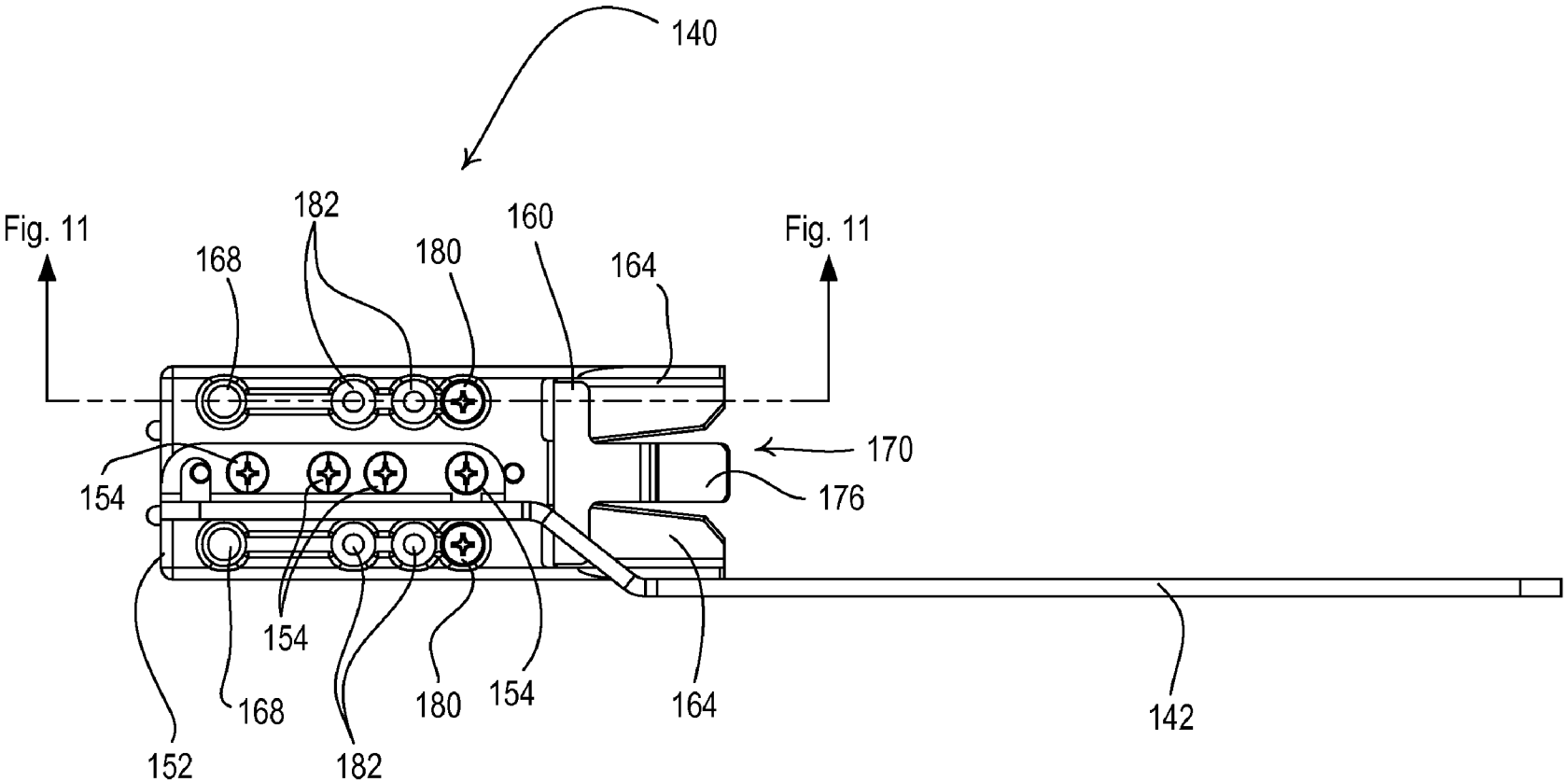
FIG. 7 is a bottom view of the non-driven portion of the master car of FIG. 4.

FIG. 6 is an exploded view and FIG. 7 is a bottom view of the non-driven portion 140 of the master car 120. The vertically-oriented wheels 146A, 146B and the horizontally-oriented wheels 148A, 148B are all rotatably mounted to a single wheel support 150. The non-driven portion 140 also comprises two horizontally-oriented wheels 149, which are adapted to roll along the edges of the elongated slot 118 of the track 112 to prevent sliding contact between the master car 120 and the edges of the slot and to keep the master car aligned as the master car moves along the length of the track.

A body 152 of the non-driven portion 140 is captured between the wheel support 150 and the drapery attachment bar 142. Four screws 154 are received through openings 156 in the drapery attachment bar 142 and are secured to the wheel support 150. The non-driven portion 140 further comprises a spring 160, which is used to couple the driven portion 130 to the non-driven portion. The spring 160 comprises two arms 162 that are positioned under extensions 164 of the body 152 and have ends attached to the body of the non-driven portion 140. Specifically, two screws 165 are received through openings 166 in the ends of the arms 162 and secured to attachment openings 168 in the body 152.

Figure 8:
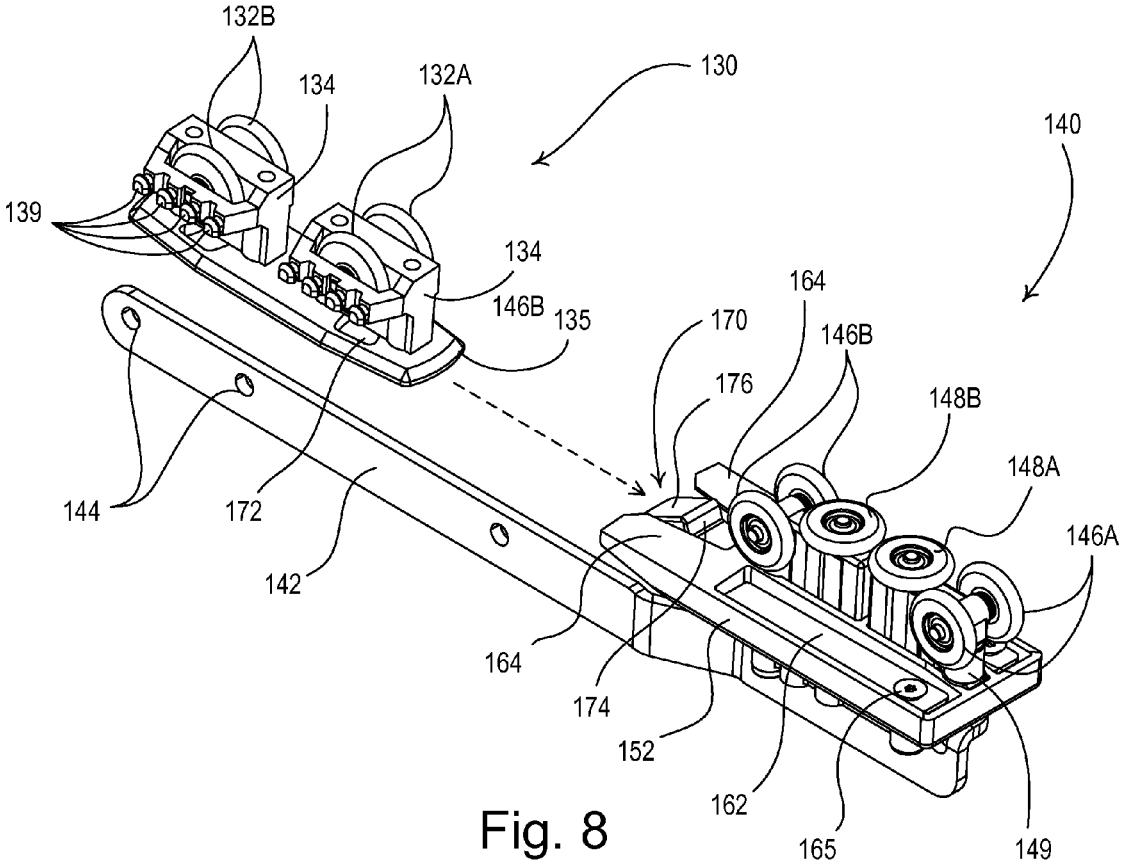
FIG. 8 is a perspective view of the driven portion and the non-driven portion of the master car of FIG. 4 showing how the driven and non-driven portions are coupled together.
Figure 9:
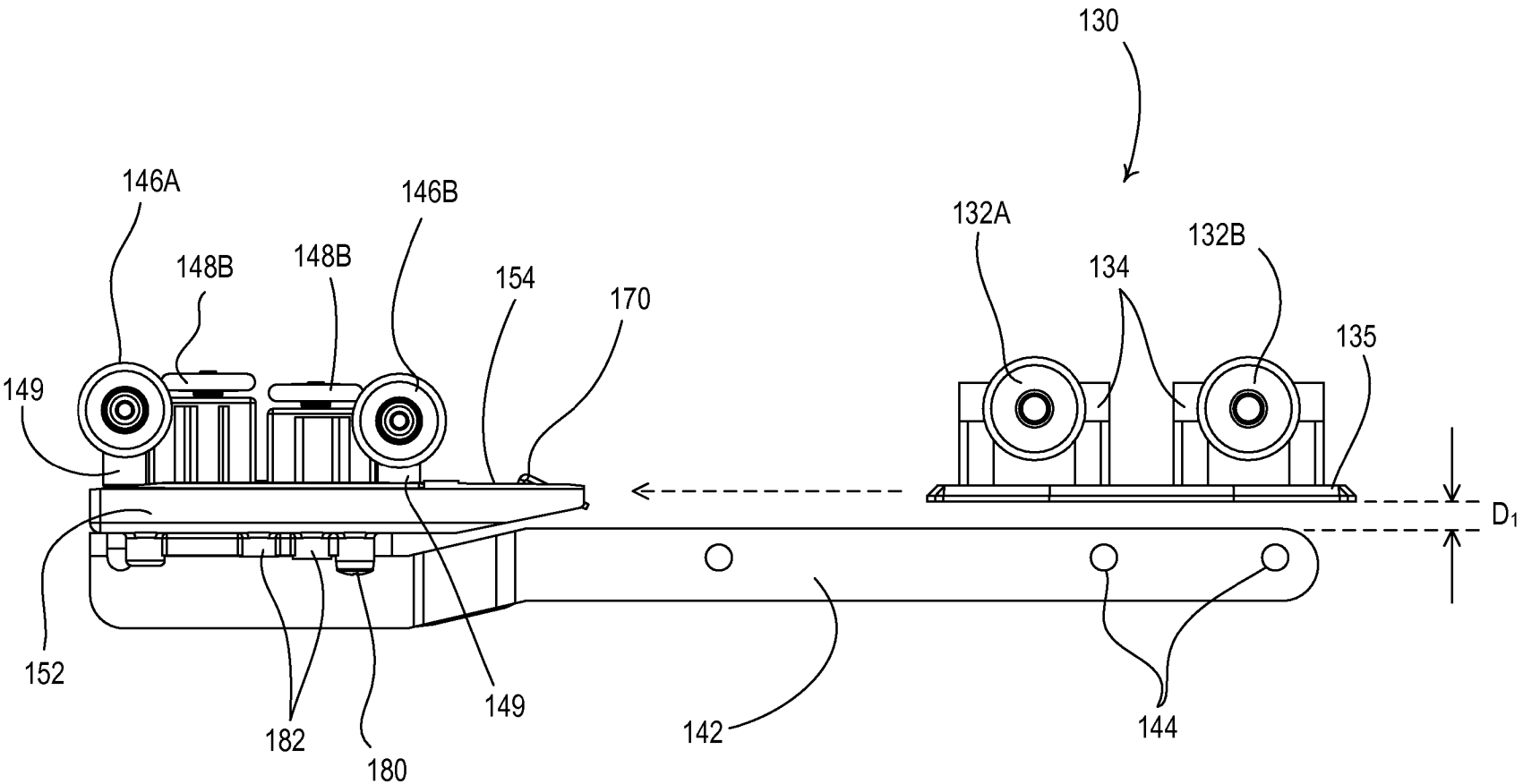
FIG. 9 is a side view of the driven portion and the non-driven portion of the master car of FIG. 4 showing how the driven and non-driven portions are coupled together.
Figure 10:
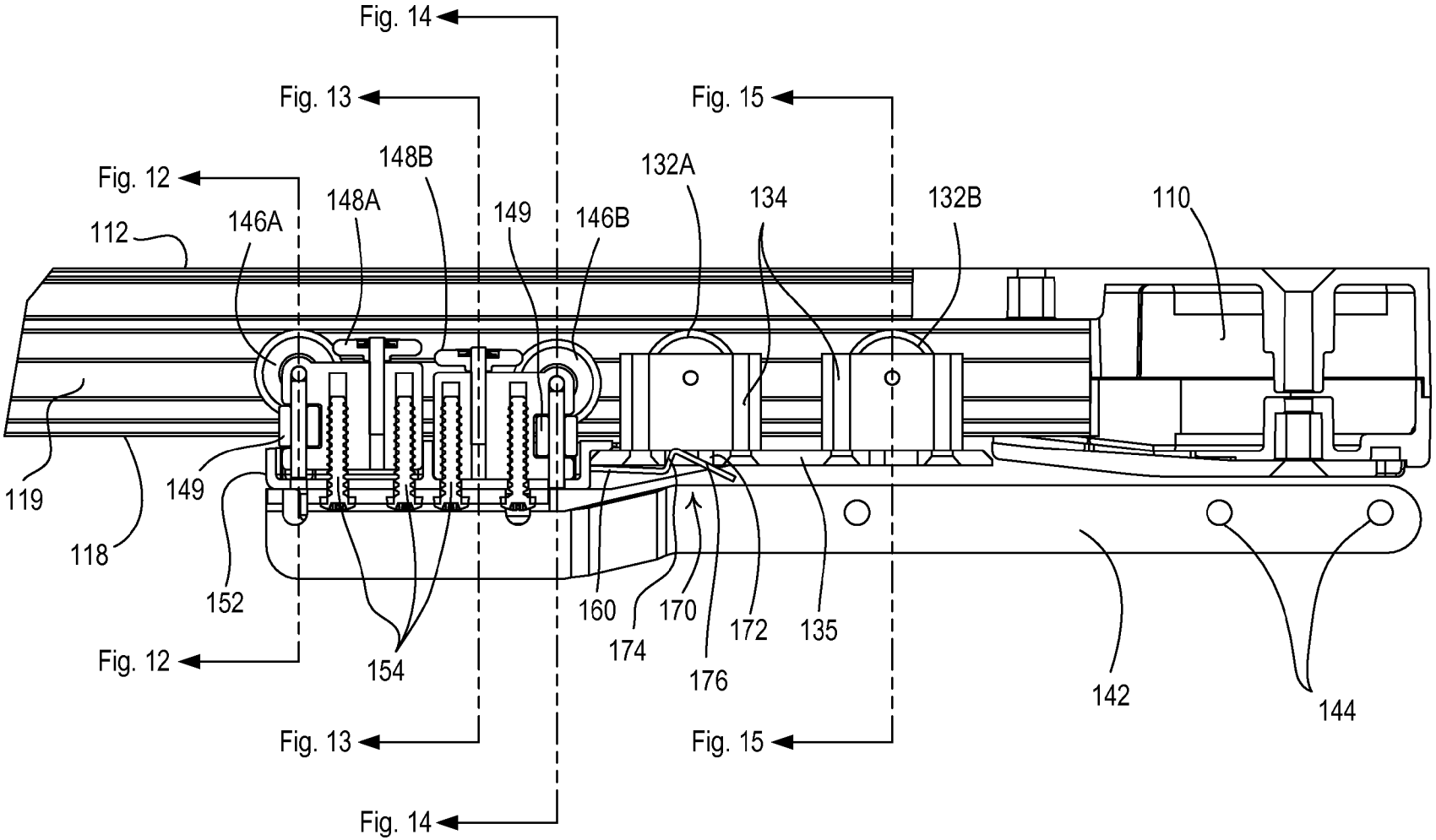
FIG. 10 is a front cross-sectional view of the drapery system taken through a center line of a track of the drapery system.

FIG. 8 is a perspective view and FIG. 9 is a front view of the driven portion 130 and the non-driven portion 140 of the master car 120 showing how the driven and non-driven portions are snapped together. FIG. 10 is a front cross-sectional view of the drapery system 100 taken through a center line of the track 112 (as shown in FIG. 3) when the non-driven portion 140 is coupled to the driven portion 130. The base 135 of the driven portion 130 is adapted to be captured between the spring 160 and the extensions 164 of the body 152. A snap 170 of the spring 160 is received within a snap-receiving structure, i.e., an opening 172 (FIG. 5), of the base 135 of the driven portion 130 to retain the non-driven portion 140 to the driven portion of the master car 120. When the non-driven portion 140 is pulled away from the driven portion 130, a first segment 174 of the snap 170 contacts the sides of the opening 172 of the base 135, such that the spring 160 flexes and the snap 170 is displaced away from the base 135. When the non-driven portion 140 is pulled completely free from the driven portion 130, the spring 160 returns to a steady state position. The non-driven portion 140 is then decoupled from the driven portion 130 and may be manually moved with respect to the driven portion.

When the driven and non-driven portions 130, 140 are decoupled, the drive system may still drive the drive belt 115 to move the driven portion along the length of the track 112. Thus, the drive system can move the driven portion 130 towards the non-driven portion 140 until the base 135 of the driven portion 130 contacts a second segment 176 of the snap 170 of the non-driven portion 140. The spring 160 flexes and the snap 170 moves across the bottom surface of the base 135 until the snap 170 is received within the opening 172 of the driven portion 130 and the driven and non-driven portions 130, 140 are coupled together once again. Alternatively, the non-driven portion 140 of the master car 120 could be manually moved until the snap 170 contacts the base 135 of the driven portion 130 and the driven and non-driven portions become coupled together. The first segment 174 of the snap 170 is connected to the second segment 176, for example, at an angle of approximately 90° (as shown in FIG. 10). The first segment 174 of the snap 170 has a slope (with respect to the horizontal axis of the track 112) having a greater magnitude than the slope of the second segment 176, such that the force required to decouple the driven and non-driven portions 130, 140 of the master car 120 is greater than the force required to couple the portions together.

Figure 11:
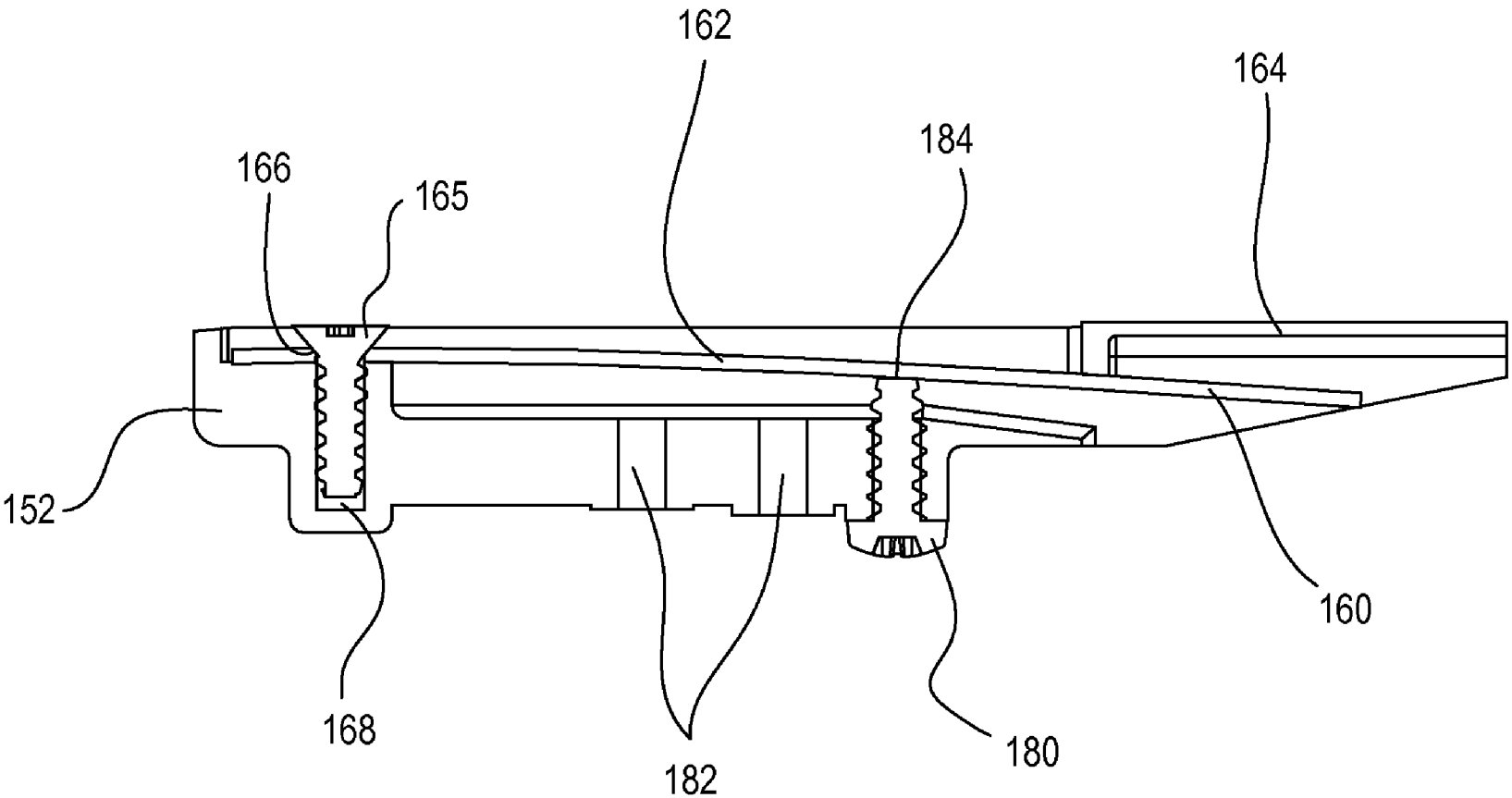
FIG. 11 is a rear cross-sectional view of the non-driven portion taken through the center line of an arm of a spring of the non-driven portion.

The tension in the spring 160 may be adjusted to allow for easier or more difficult coupling and decoupling of the driven and non-driven portions 130, 140 of the master car 120. Specifically, the location of the fulcrum (or pivot point) of the spring 160 is moved to adjust the tension in the spring. Referring to FIGS. 6 and 7, the non-driven portion 140 comprises a pair of adjustment screws 180, which are adapted to be received by openings 182 on the bottom surface of the body 152. To set the tension in the spring 160 (to one of a plurality of discrete tensions), the adjustment screws 180 are screwed into one of the pairs of openings 182 until the adjustment screws 180 contact the lower surface of the arms 162 of the spring 160. FIG. 11 is a rear cross-sectional view of the non-driven portion 140 taken through the center line of one of the arms 162 of the spring 160. A point of contact 184 between the adjustment screws 180 and the arms 162 of the spring 160 defines the fulcrum (i.e., the pivot point) of the spring. The force required to couple and decouple the driven and non-driven portions 130, 140 of the master car 120 is greater when the adjustment screws 180 are screwed into the openings 182 farther from the ends of the arms 162 of the spring 160 (i.e., to the right as shown in FIG. 11) than when the adjustment screws are screwed into the openings close to the ends of the arms of the spring.

Alternatively, the tension in the spring 160 could be continuously variable using a slider mechanism (not shown) rather than the adjustment screws 180. The slider mechanism would include point-contact structures to contact the arms 162 of the spring 160 at the pivot points 184. The slider mechanism would allow for continuously-variable adjustment of the position of the point-contact structures along the length of the arms 162 to allow for continuous adjustment of the pivot points 184 and thus the tension of the spring 160.

Figure 12:
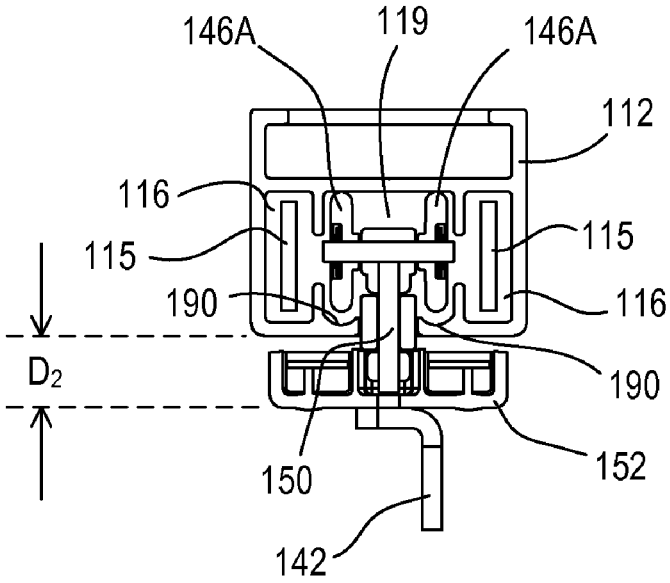
FIG. 12 is a side cross-sectional view of the drapery system taken through a first set of vertically-oriented wheels of the non-driven portion of the master car.
Figure 13:
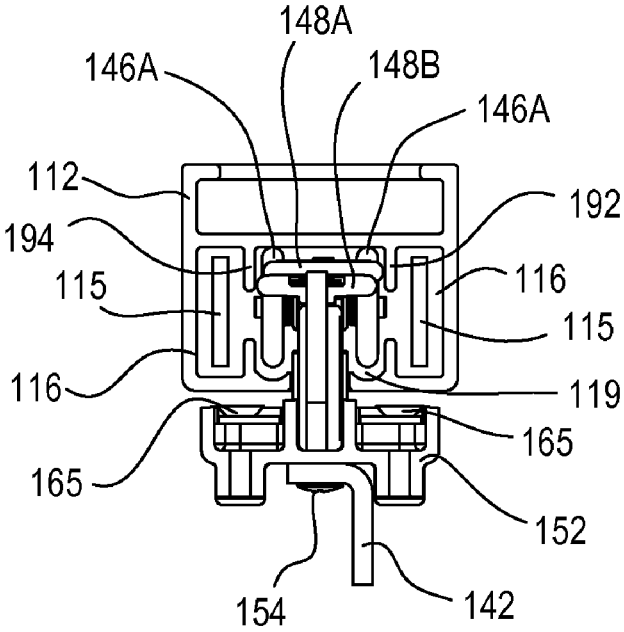
FIG. 13 is a side cross-sectional view of the drapery system taken through a second horizontally-oriented wheel of the non-driven portion of the master car.
Figure 14:
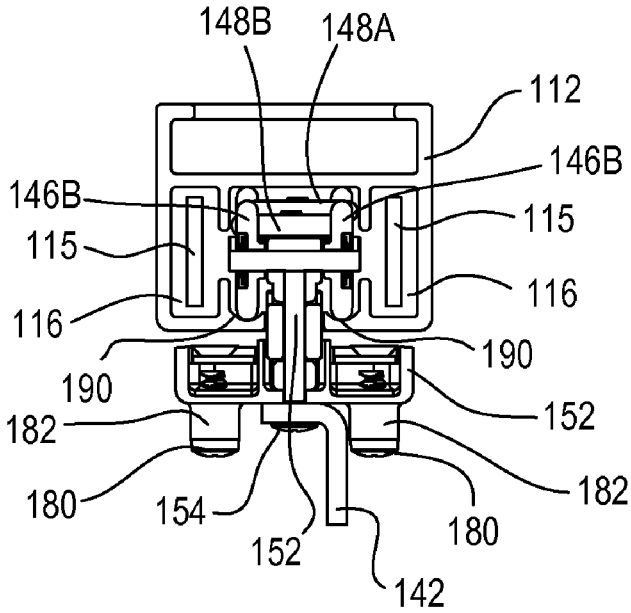
FIG. 14 is a side cross-sectional view of the drapery system taken through a second set of vertically-oriented wheels of the non-driven portion of the master car.
Figure 15:
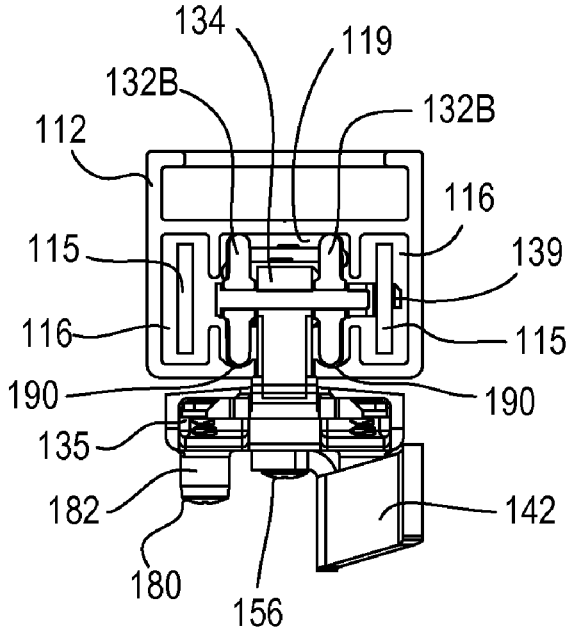
FIG. 15 is a side cross-sectional view of the drapery system taken through a second set of vertically-oriented wheels of the driven portion of the master car.

FIG. 12 is a side cross-sectional view of the drapery system 100 taken through the first pair of vertically-oriented wheels 146A of the non-driven portion 140 of the master car 120 as shown in FIG. 10. FIG. 13 is a side cross-sectional view of the drapery system 100 taken through the second horizontally-oriented wheel 148B of the non-driven portion 140 of the master car 120 as shown in FIG. 10. FIG. 14 is a side cross-sectional view of the drapery system 100 taken through the second pair of vertically-oriented wheels 146B of the non-driven portion 140 of the master car 120 as shown in FIG. 10. FIG. 15 is a side cross-sectional view of the drapery system 100 taken through the second pair of vertically-oriented wheels 132B of the driven portion 130 of the master car 120 as shown in FIG. 10.

Referring to FIG. 15, the vertically-oriented wheels 132A, 132B of the driven portion 130 of the master car 120 roll through grooves 190 in the drapery car channel 119. The drive belt 115 extends through the belt channels 116 and is attached to the posts 139 of the driven portion 130 of the master car 120. Accordingly, the driven portion 130 of the master car 120 is adapted to roll from one end of the track 112 to the other end in response to movement of the drive belt 115.

The sizes of as well as the orientations and locations of the axes of rotation of the wheels 146A-148B of the non-driven portion 140 help to prevent binding of the wheels during movement of the master car 120. Because of the grooves 190 in the drapery car channel 119, the distance between the top and the bottom of the drapery car channel is not constant along the width of the channel (as can be seen in FIGS. 12-15). Therefore, the diameters of the vertically-oriented wheels 146A, 146B are all less than the distance between the top and the bottom of the drapery car channel 119 such that the vertically-oriented wheels 146A, 146B do not extend from the top to the bottom of the drapery car channel. For example, the diameters of the vertically-oriented wheels may be approximately 0.55 inch, while the distance between the top and the bottom of the drapery car channel may be approximately 0.612 inch. Accordingly, the vertically-oriented wheels 146A, 146B of the non-driven portion 140 do not bind between the top and the bottom of the drapery car channel 119 as the master car 120 moves along the length of the track 112.

Since the vertically-oriented wheels 146A, 146B do not extend from the top to the bottom of the drapery car channel 119, the axes of rotation of the vertically-oriented wheels are offset from each other in a vertical direction (as shown in FIGS. 9 and 14). The first pair of vertically-oriented wheels 146A is adapted to roll across the top of the drapery car channel 119 (as shown in FIG. 12), while the second pair of vertically-oriented wheels 146B is adapted to roll through the grooves 190 in the bottom of the drapery car channel (as shown in FIG. 14). If the drapery fabric and the drapery attachment bar 142 are pulled down (i.e., displaced in a vertical direction), the non-driven portion 140 of the master car 120 does not become misaligned in the track 112 since the first pair of vertically-oriented wheels 146A contacts the top of the drapery car channel 119, and the second pair of vertically-oriented wheels 146B contacts the bottom of the drapery car channel. Thus, the wheels 146A, 146B of the non-driven portion 140 of the master car 120 do not bind if the drapery fabric is pulled down while the master car is moving along the length of the track 112.

As shown in FIG. 13, the axes of rotation of the horizontally-oriented wheels 148A, 148B are offset from each other in a horizontal direction. The horizontally-oriented wheels 148A, 148B are also provided in different parallel planes that are offset from each other in a vertical direction. The first horizontally-oriented wheel 148A is adapted to roll across a rear wall 192 of the drapery car channel 119, while the second horizontally-oriented wheel 148B is adapted to roll across a front wall 194. If the drapery fabric is pulled away from the window towards the front wall 194 (i.e., left as shown in FIG. 13), the master car 120 does not become misaligned in the track 112 since the first horizontally-oriented wheel 148A contacts the rear wall 192, while the second horizontally-oriented wheel 148B contacts the front wall 194. Additionally, the grooves 190 of the drapery car channel 119 assist in correctly aligning the second pair of vertically-oriented wheels 146B as the master car rolls through the drapery car channel 119. Accordingly, the master car 120 is not misaligned if the drapery fabric is pulled in a horizontal direction away from the window (i.e., towards the front wall 194 of the drapery car channel 119) while the master car 120 is moving along the length of the track 112.

The construction of the master car 120 and the use of the snap 170 to couple the driven and non-driven portions 130, 140 allows the master car 120 to have a "low profile". Specifically, a clearance (i.e., a distance $D_1$, for example, approximately 0.123 inch) is provided between the bottom of the driven portion 130 and the drapery attachment bar 142 as shown in FIG. 9, such that the drapery attachment bar 142 of the non-driven portion 140 may be located directly below the driven portion 130. Further, a distance $D_2$ (e.g., approximately 0.382 inch) between the bottom of the track 112 and the bottom of the body of the non-driven portion 140 (as shown in FIG. 12) is minimized.

Because the master car 120 has a low profile and the drapery attachment bar 142 is situated directly below the driven portion 130, the pull-away master car described herein can be easily used with a split-draw motorized drapery system. A split-draw motorized drapery system has two drapery fabrics, which overlap at the center of the window when the motorized drapery system is closed and move outwards from the center when the motorized drapery system is opened. Accordingly, the split-draw motorized drapery system has two pull-away master cars 120, i.e., one for each drapery fabric. The slight bend of the drapery attachment bar 142 allows the two drapery fabrics to overlap at the center of the window. When the split-draw motorized drapery system is closed, the drapery attachment bars 142 of both of the master cars 120 are situated below the driven portions 130 of the master cars. The bends of the drapery attachment bars only needs to offset the drapery fabrics enough such that the drapery fabrics do not interfere with each other when the drapery system is closed.

Figure 16:
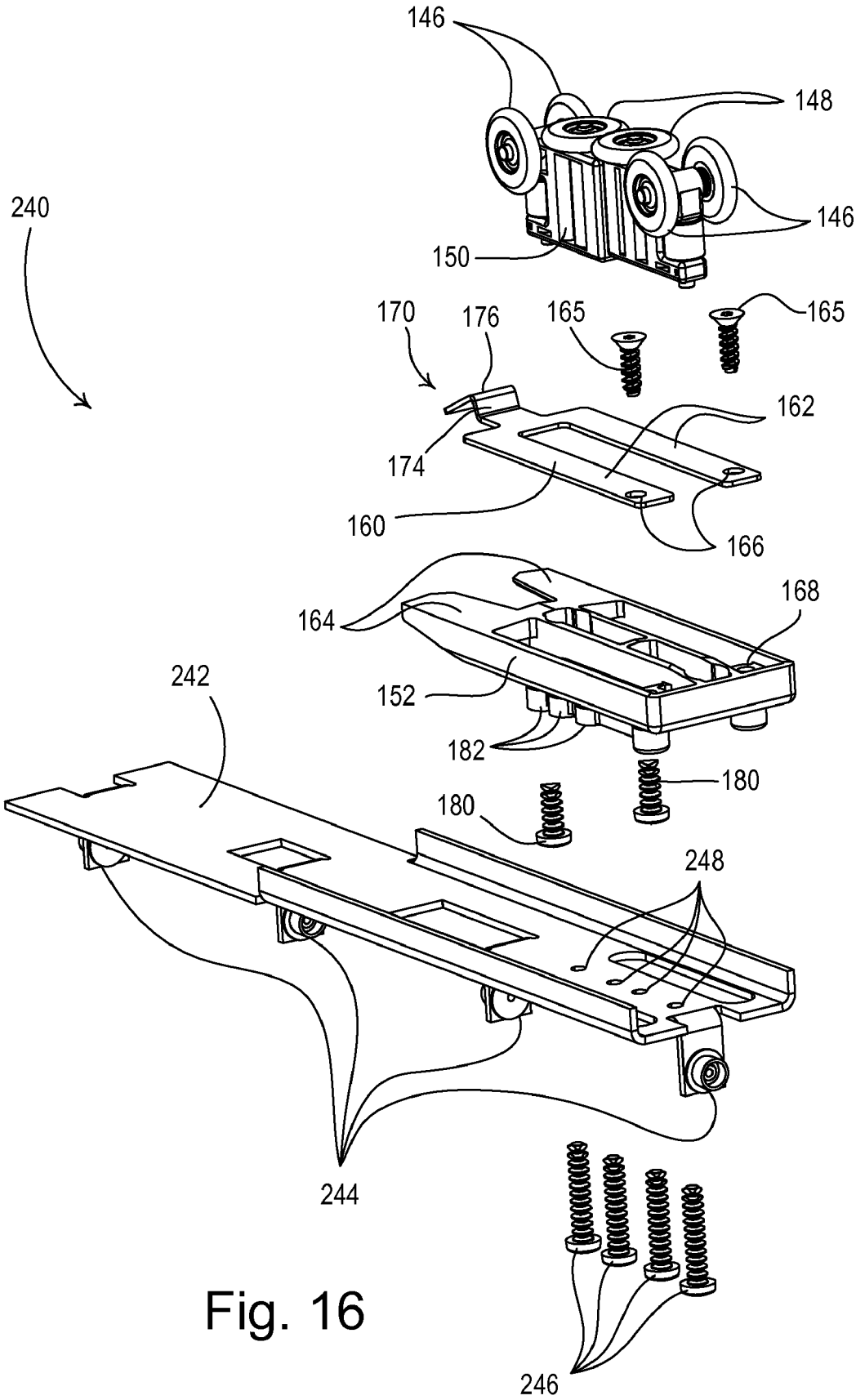
FIG. 16 is an exploded perspective view of a non-driven portion having a ripple-fold drapery attachment bar for attachment to a ripple-fold drapery fabric according to a second embodiment of the present invention.
Figure 17:
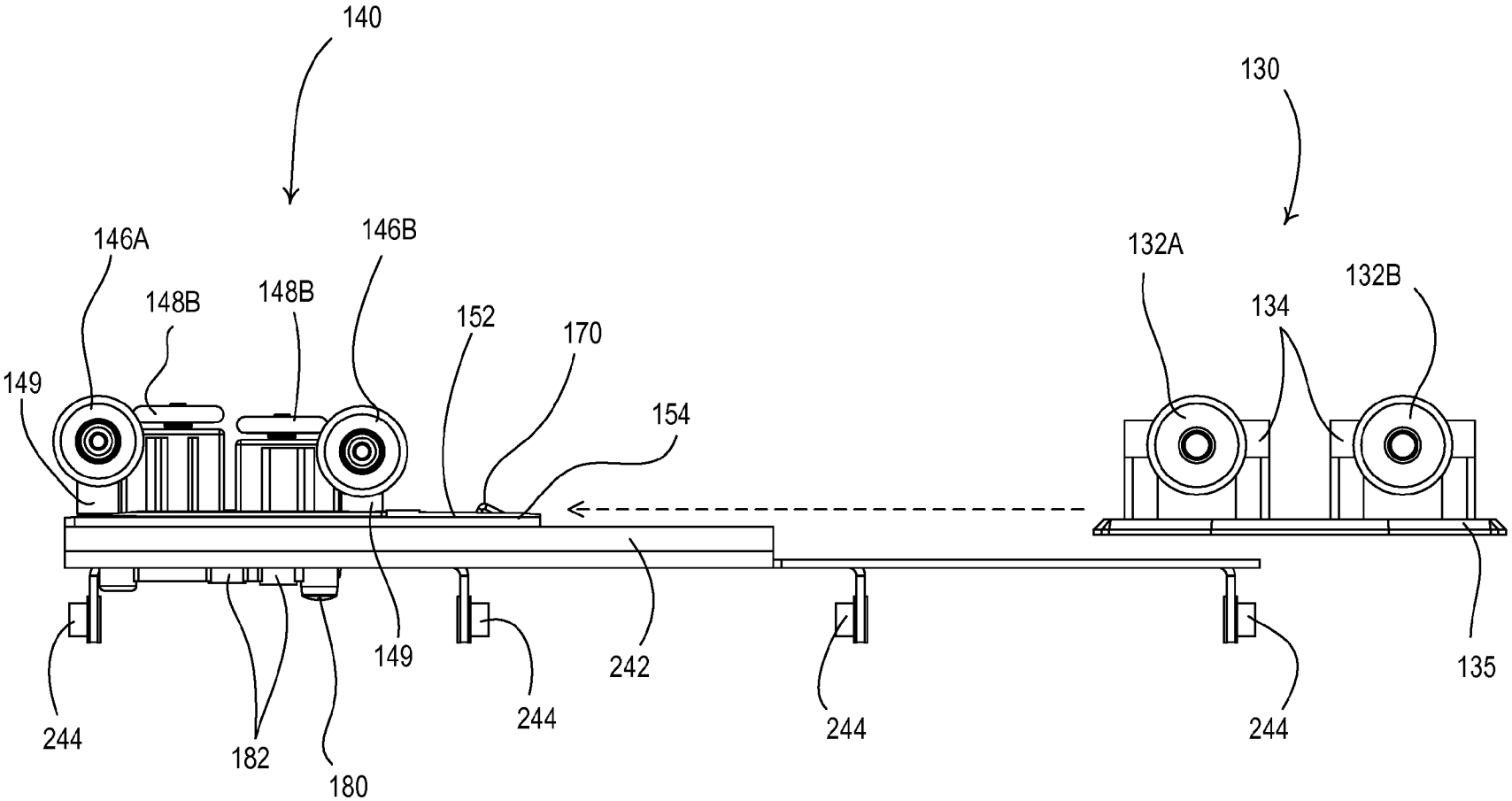
FIG. 17 is a side view of the driven portion of FIG. 4 and the non-driven portion of FIG. 16 according to the second embodiment showing how the driven and non-driven portions are snapped together.

The low profile of the master car 120 also allows the master car to be used with ripple-fold drapery fabrics. FIG. 16 is an exploded perspective view of a non-driven portion 240 having a ripple-fold drapery attachment bar 242 for attachment to a ripple-fold drapery fabric (not shown) according to a second embodiment of the present invention. FIG. 17 is a side view of the driven portion 130 and the non-driven portion 240 according to the second embodiment showing how the driven and non-driven portions are coupled together. The drapery attachment bar 242 comprises a plurality of snaps 244, which are adapted to be connected to corresponding snaps (not shown) provided on each ripple of the ripple-fold fabric. The drapery attachment bar 242 is connected to the wheel support 150 via screws 246 received through openings 248.

Figure 18:
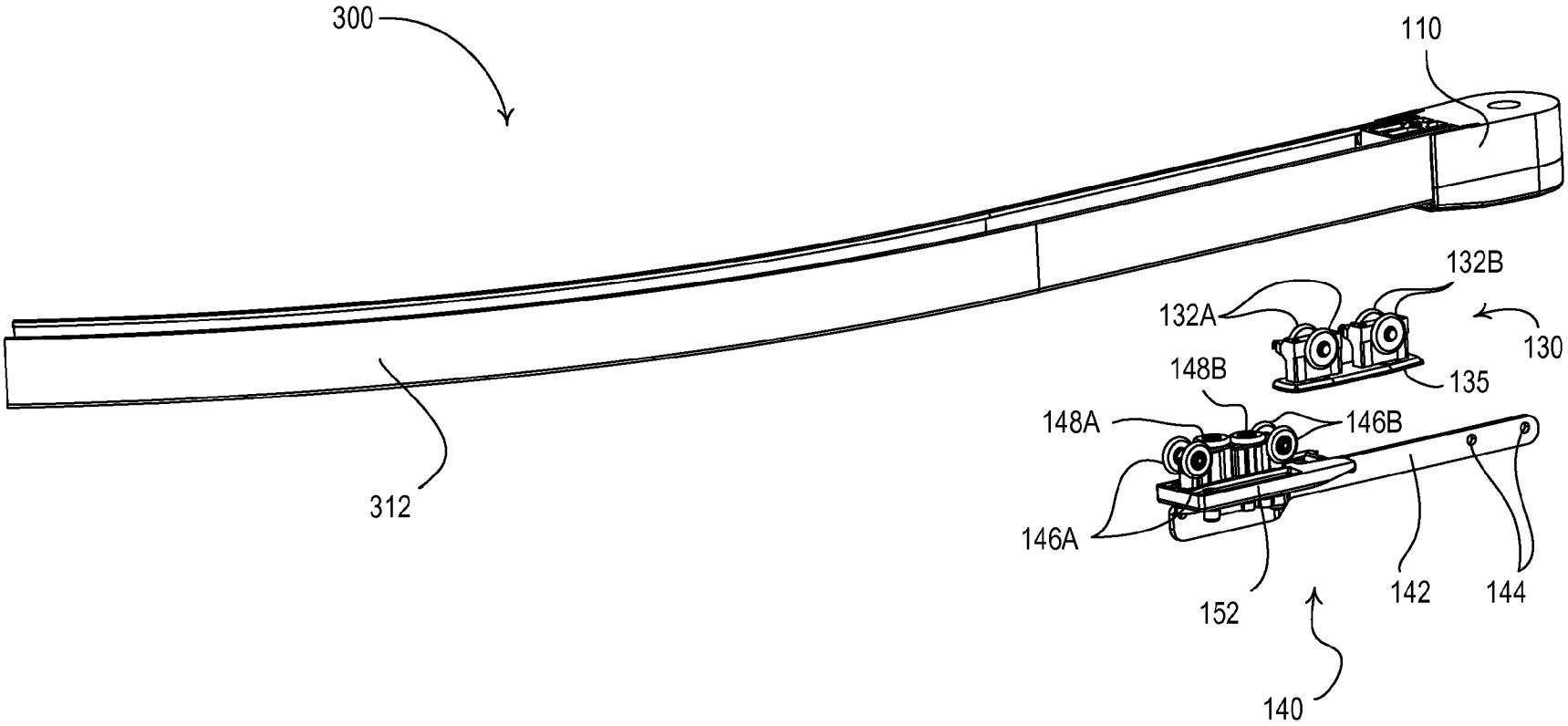
FIG. 18 is a partially-exploded perspective view of a motorized drapery system having a curved track according to a third embodiment of the present invention.

Because of the low profile of the master car 120, the master car may also be used with curved tracks. FIG. 18 is a partially-exploded perspective view of a portion of a motorized drapery system 300 having a curved track 312 according to a third embodiment of the present invention. As the master car 120 moves along the curved track 312, the drapery attachment bar 142 of the non-driven portion 140 is able to swing underneath the driven portion 130 without interference with the driven portion 130.

While the master car 120 has been described herein where the non-driven portion 140 comprises the spring 160 and driven portion 130 the snap-receiving opening 172 of the base 135, the master car could be alternatively implemented such that the driven portion 130 comprises the spring 160 and the non-driven portion 140 comprises the snap-receiving opening 172.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drapery system for moving a suspended drapery fabric comprising:

an elongated track having belt channels and a drapery car channel;

a drive belt received within the belt channels of the track; and a master car received within the drapery car channel of the track, the master car comprising a driven portion coupled to the drive belt and a non-driven portion adapted to be coupled to the drapery fabric, the driven portion and the non-driven portion comprising a plurality of vertically-oriented wheels adapted to roll through the drapery car channel, the master car comprising a spring having a snap adapted to be received in a snap-receiving structure, such that the driven portion is coupled to the non-driven portion, the non-driven portion operable to roll through the drapery car channel in response to movement of the drive belt to move the drapery fabric along a length of the track when the non-driven portion is coupled to the driven portion;

wherein the non-driven portion is operable to be decoupled from the driven portion, such that the drapery fabric may be manually moved along the length of the track, the snap of the master car comprising a first segment and a second segment connected to the first segment, the first and second segments having respective slopes with respect to a horizontal axis of the track, the slope of the first segment having a greater magnitude than the slope of the second segment, such that the force required to decouple the driven and non-driven portions of the master car is greater than the force required to couple the portions together.

2. The drapery system of claim 1, wherein the non-driven portion further comprises a drapery attachment bar adapted to be attached to the drapery fabric.

3. The drapery system of claim 2, wherein the non-driven portion comprises first and second pairs of vertically-oriented wheels adapted to roll through grooves in a drapery car channel of the track, the wheels having diameters less than the distance between the top to the bottom of the drapery car channel and the axes of rotation of the vertically-oriented wheels offset from each other in a vertical direction, such that the wheels are prevented from binding if the drapery attachment bar is displaced in a vertical direction as the master car moves along the length of the track.

4. The drapery system of claim 3, wherein the non-driven portion further comprises first and second horizontally-oriented wheels, the axes of rotation of the horizontally-oriented wheels offset from each other in a horizontal direction, such that the master car is not misaligned if the drapery attachment bar is displaced in a horizontal direction as the master car moves along the length of the track.

5. The drapery system of claim 4, wherein the horizontally-oriented wheels are provided in different parallel planes that are offset from each other in a vertical direction.

6. The drapery system of claim 4, wherein the first horizontally-oriented wheel rolls along a rear wall of the drapery car channel and the second horizontally-oriented wheel rolls along a front wall of the drapery car channel, such that the wheels are prevented from binding if the drapery attachment bar is pulled towards the front wall as the master car moves along the length of the track.

7. The drapery system of claim 3, wherein the first pair of vertically-oriented wheels rolls along the top of the drapery car channel and the second pair of vertically-oriented wheels rolls along the bottom of the drapery car channel, such that the master car is not misaligned if the drapery attachment bar is pulled down as the master car moves along the length of the track.

8. The drapery system of claim 2, wherein the master car has a low-profile, such that the drapery attachment bar of the non-driven portion is located directly below the driven portion.

9. The drapery system of claim 8, wherein the drapery attachment bar comprises a ripple-fold drapery attachment bar adapted to be coupled to a ripple-fold drapery fabric.

10. The drapery system of claim 9, wherein the ripple-fold drapery attachment bar comprises a plurality of snaps adapted to be coupled to corresponding snaps on the ripples of the ripple-fold drapery fabric.

11. The drapery system of claim 8, wherein drapery system comprises a split-draw drapery system having two master cars, each master car comprising a non-driven portion and a driven portion, the non-driven portions of each master car comprising a drapery attachment bar, the drapery attachment bars adapted to be located directly below the driven portions of the master cars when the drapery system is closed.

12. The drapery system of claim 8, wherein the elongated track comprises a curved track, the drapery attachment bar adapted to swing underneath the driven portion as the master car moves along the length of the track.

13. The drapery system of claim 1, further comprising:

means for adjusting the tension in the spring;

wherein the means for adjusting the tension in the spring changes the location of a fulcrum of the spring to adjust the tension in the spring.

14. The drapery system of claim 13, wherein the spring comprises an arm having an end opposite the snap, the end of the arm connected to a body of the non-driven portion, the non-driven portion further comprising an adjustment screw adapted to be tightened against the arm of the spring at multiple locations, so as to change the location of the fulcrum of the spring to thus adjust the tension in the spring.

15. The drapery system of claim 1, wherein the first segment is connected to the second segment at an angle of approximately 90 degrees.

16. A master car for a drapery system for moving a suspended drapery fabric, the drapery system comprising an elongated track having belt channels and a drapery car channel, and a drive belt received within the belt channels of the track, the master car comprising:

a driven portion adapted to be received within the drapery car channel of the track and to be coupled to the drive belt, the driven portion comprising a plurality of vertically-oriented wheels adapted to roll through the drapery car channel;

a non-driven portion adapted to be received within the drapery car channel of the track, the non-driven portion comprising a drapery attachment bar adapted to be coupled to the drapery fabric and a plurality of vertically-oriented wheels adapted to roll through the drapery car channel;

a snap-receiving structure; and a spring having a snap adapted to be received by the snap-receiving structure, such that the non-driven portion is coupled to the driven portion, the non-driven portion operable to roll through the drapery car channel in response to movement of the drive belt when the non-driven portion is coupled to the driven portion;

wherein the non-driven portion is operable to be decoupled from the driven portion, such that the drapery fabric may be manually moved along the length of the track, the snap of the spring comprising a first segment and a second segment connected to the first segment, the first and second segments having respective slopes with respect to a horizontal axis of the track, the slope of the first segment having a greater magnitude than the slope of the second segment, such that the force required to decouple the driven and non-driven portions of the master car is greater than the force required to couple the portions together.

17. The master car of claim 16, wherein the non-driven portion comprises a drapery attachment bar adapted to be attached to the drapery fabric, the non-driven portion further comprising first and second pairs of vertically-oriented wheels, the vertically-oriented wheels having diameters less than the distance between the top to the bottom of the drapery car channel and the axes of rotation of the vertically-oriented wheels offset from each other in a vertical direction, such that the wheels are prevented from binding if the drapery attachment bar is pulled in a vertical direction as the master car moves along the length of the track.

18. The master car of claim 17, wherein the non-driven portion further comprises first and second horizontally-oriented wheels, the axes of rotation of the horizontally-oriented wheels offset from each other in a horizontal direction, such that the master car is not misaligned if the drapery attachment bar is pulled in a horizontal direction as the master car moves along the length of the track.

19. The master car of claim 16, wherein the location of a fulcrum of the spring is adjustable to allow for adjustment of the amount of the tension in the spring and thus the force required to couple and decouple the driven and non-driven portions.

20. The master car of claim 19, wherein the spring comprises an arm having an end opposite the snap, the end of the arm connected to a body of the non-driven portion, the non-driven portion further comprising an adjustment screw adapted to be tightened against the arm of the spring at multiple locations, so as to change the location of the fulcrum of the spring to thus adjust the tension in the spring.

21. A drapery system for moving a suspended drapery fabric comprising:

an elongated track having belt channels and a drapery car channel;

a drive belt received within the belt channels of the track;

a master car received within the drapery car channel of the track, the master car comprising a driven portion coupled to the drive belt and a non-driven portion adapted to be coupled to the drapery fabric, the driven portion and the non-driven portion comprising a plurality of vertically-oriented wheels adapted to roll through the drapery car channel, the master card comprising a spring having a snap adapted to be received in a snap-receiving structure, such that the non-driven portion is coupled to the driven portion, the non-driven portion operable to roll through the drapery car channel in response to movement of the drive belt to move the drapery fabric along the length of the track when the non-driven portion is coupled to the driven portion;

wherein the non-driven portion is operable be decoupled from the driven portion, such that the drapery fabric may be manually moved along the length of the track, the location of a fulcrum of the spring being adjustable in order to adjust the tension in the spring and thus the amount of force required to couple and decouple the driven and non-driven portions.

22. A drapery system for moving a suspended drapery fabric comprising:

an elongated track having belt channels and a drapery car channel;

a drive belt received within the belt channels of the track;

a master car received within the drapery car channel of the track, the master car comprising a driven portion coupled to the drive belt and a non-driven portion comprising a drapery attachment bar adapted to be coupled to the drapery fabric, the driven portion and the non-driven portion comprising a plurality of vertically-oriented wheels adapted to roll through the drapery car channel, the master car comprising a spring having a snap adapted to be received in a snap-receiving structure, such that the driven portion is coupled to the non-driven portion, the non-driven portion operable to roll through the drapery car channel in response to movement of the drive belt to move the drapery fabric along the length of the track when the non-driven portion is coupled to the driven portion, the non-driven portion operable be decoupled from the driven portion, such that the drapery fabric may be manually moved along the length of the track;

wherein the non-driven portion comprises first and second pairs of vertically-oriented wheels and first and second horizontally-oriented wheels, the vertically-oriented wheels having diameters less than the distance between the top to the bottom of the drapery car channel and the axes of rotation of the vertically-oriented wheels offset from each other in a vertical direction, such that the wheels are prevented from binding if the drapery attachment bar is pulled in a vertical direction as the master car moves along the length of the track, the axes of rotation of the horizontally-oriented wheels offset from each other in a horizontal direction, such that the master car is not misaligned if the drapery attachment bar is pulled in a horizontal direction as the master car moves along the length of the track.

23. The drapery system of claim 21, wherein the spring comprises an arm having an end opposite the snap, the end of the arm connected to a body of the non-driven portion, the non-driven portion further comprising an adjustment screw adapted to be tightened against the arm of the spring at multiple locations, so as to change the location of the fulcrum of the spring to thus adjust the tension in the spring.

* * * * *